United States Patent [19]

Schloss

[11] Patent Number: 4,807,772

[45] Date of Patent: Feb. 28, 1989

[54] POLYPROPYLENE CLOSURE WITH REMOVABLE LINER

[75] Inventor: Francis M. Schloss, Perrysburg, Ohio

[73] Assignee: Owens-Illinois Closure Inc., Toledo, Ohio

[21] Appl. No.: 164,284

[22] Filed: Mar. 4, 1988

[51] Int. Cl.[4] ..... B65D 53/04

[52] U.S. Cl. ..... 215/349; 264/268

[58] Field of Search ..... 215/349, 341, 347; 264/268

[56] References Cited

U.S. PATENT DOCUMENTS

| | | | |
|---|---|---|---|
| 2,072,536 | 3/1937 | Trickey et al. | 264/268 X |
| 2,131,319 | 9/1938 | Greenholtz et al. | 264/268 |
| 3,866,845 | 2/1975 | Keeler et al. | 215/341 |
| 4,497,765 | 2/1985 | Wilde et al. | 264/268 |

*Primary Examiner*—Donald F. Norton

[57] ABSTRACT

A polypropylene compression molded closure with an elastomer liner that is removable, the elastomer being a blend of polyethylene and a rubbery copolymer, containing oil.

8 Claims, 1 Drawing Sheet

POLYPROPYLENE CLOSURE WITH REMOVABLE LINER

The present invention relates to a polypropylene closure having a top and having a compressioned molded plastic liner on the inside of the closure top.

BACKGROUND OF THE INVENTION

In the past, polypropylene closures have been made with a compression-molded liner on the inside of the closure top. It is desirable to have a liner that is removable for some applications. However such liners were not removable and removal efforts resulted in tearing and destruction of the liner material. Apparently the polypropylene of the cap and the material in the liner fused and formed a strong bond from the heat and pressure of the compression molding operation.

It is highly desirable to have a good efficient liner that can be easily removed for some applications.

OBJECTS OF THE INVENTION

It is an object of the present invention to provide a polyethylene based thermoplastic elastomer (blend of polyethylene and a rubbery copolymer and a mineral oil or petroleum oil) that can be compression molded into a polypropylene closure on the inside top of the closure, the liner having little adhesion to the closure and being easily removable therefrom.

It is an object of the present invention to provide a polypropylene closure with a top and a depending skirt, a liner for the inside of the top that is compression molded with the closure, the liner being removable without tearing, the liner being a blend of (a) polyethylene, (b) a thermoplastic elastomer that is a copolymer of styrene and a copolymerizable monomer and (c) a mineral oil or petroleum oil.

These and other objects will be apparent from the specification that follows, the appended claims, and the drawings, in which:

FIG. 1 is a perspective view of a compression molded polypropylene closure showing the removable plastic liner removed from the inside top of the closure.

SUMMARY OF THE INVENTION

The present invention provides a closure assembly including a polypropylene closure or cap with a removable elastomeric liner that is a blend of polyethylene and a rubbery copolymer of styrene and another copolymerizable monomer such as butadiene.

The present invention also provides a method of making a polypropylene closure cap with a removable lining, the closure having a top closure wall with an inner and outer wall, the method comprising: compression molding a liner on the inner wall of the closure top, the liner being removable, elastomeric, and being a blend of polyethylene and a copolymer of styrene an a copolymerizable monomer.

DETAILED DESCRIPTION OF THE INVENTION

Figure 1:
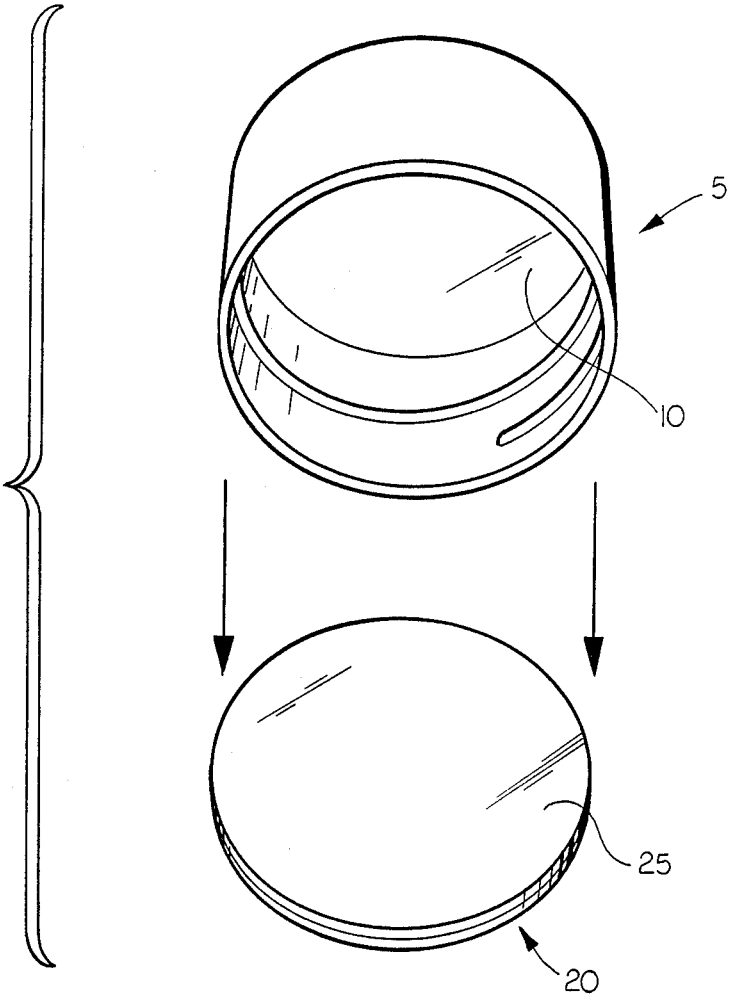

In the drawings, a compression molded polypropylene closure or cap 5 is shown, the closure having an inside top surface 10. An elastomeric liner 20 is provided, the liner having a surface 25 that is adjacent the closure top surface 10 when the closure is assembled. The liner 20 is removable without damage as shown in FIG. 1.

The polypropylene closure is preferably compression molded with a compression molded elastomeric liner that is a blend of generally about 20 to 60 wt. % and preferably about 30 to 50 wt. % polyethylene and generally about 40 to 50 wt. % and preferably 50 to 70 wt. % of the rubbery copolymer. The rubbery copolymer blend generally contains about 20 to 50 wt. % mineral oil or petroleum oil.

The best results are obtained generally when the polymer blend, exclusive of oil, is about 40 wt. % polyethylene and 60 wt. % copolymer. As to the oil, about 40 wt. % oil generally provides the best results.

The copolymerizable monomer for the styrene of the elastomer of the blend is preferably butadiene, although isoprene and ethylene butylene can be used to provide benefits of the invention. The rubbery copolymer can be a copolymer of ethylene and propylene.

The elastomeric copolymer is preferably a block copolymer of styrene and butadiene or hydrogenated butadiene or ethylene butylene. A suitable block copolymer is a copolymer material Kraton-G TM sold by Shell.

A suitable block copolymer is one of styrene and butadiene, for instance, prepared by anionic polymerization. The copolymers are thermoplastic rubbers, showing the behavior of vulcanized elastomers at room temperature with hard chain length blocks of styrene acting similarly to crosslinks to prevent creep in the polybutadiene block matrix. At higher temperatures, they undergo normal plastic flow.

The butadiene component of the copolymer can be replaced by isoprene or ethylene butylene as, for instance, is available as Kraton ® rubber materials including 1102 and 1107 from Shell Chemical.

Stereon 840A and other Stereon ® elastomers, available from Firestone, Akron, Ohio, are suitable butadiene-styrene block copolymer elastomers, the block copolymer containing about 35 to 55 wt. % bound styrene and having a number average molecular weight of about 50,000 to 100,000. Stereon 840A brochures list two of the block copolymers having 53 and 43 wt. bound styrene and number average molecular weight about 60,000 to 80,000.

In the present invention, the compression molding is done in an apparatus similar to that shown in H-C Industries, Inc. U.S. Pat. No. 4,497,765, this patent being incorporated herein by reference. In column 7, lines 42–48, a polypropylene compression molded cap is disclosed and a compression molded cap 12 is shown in FIGS. 1 and 2.

The compression molded cap or closure is made and then the liner compression molded in the cap using similar compression molding equipment and techniques. The molded liner is generally about 2 to 5 mils up to 10 or 20 mils or more in thickness.

In the present invention, using the polypropylene cap, experimental Teknor Apex Telcar 83F943DNT Grey 744 (with polypropylene) elastomer liner stuck to the cap. The elastomeric liner with polyethylene in the blend did not stick excessively to the polypropylene cap, the elastomer being experimental Telcar 86K982A.

What is claimed is:

1. A polypropylene closure with a top and a depending skirt, a liner for the inside of the top that is compression molded with the closure, the liner being removable without tearing, the liner being a blend of polyethylene and a thermoplastic, elastomeric copolymer.

2. A closure as defined in claim 1 in which the copolymer is a block copolymer of styrene and butadiene, the blend also containing mineral oil or petroleum oil.

3. A closure as defined in claim 1 in which the copolymer is a block copolymer of styrene and ethylene butylene.

4. A closure as defined in claim 1 in which the elastomer is a copolymer of ethylene and propylene.

5. A closure as defined in claim 1 in which the blend is about 40 to 80 wt. % copolymer and about 20 to 50 wt. % polyethylene.

6. A closure as defined in claim 1 in which the blend is about 60 wt. % copolymer and about 40% polyethylene.

7. A method of making a polypropylene closure cap with a removable lining, the closure having a top closure wall with an inner and outer wall, the method comprising:

compression molding a liner on the inner wall of the closure top, the liner being removable, elastomeric, and being a blend of polyethylene and a copolymer of styrene and a copolymerizable monomer.

8. A method as defined in claim 7 in which the blend also contains mineral oil or petroleum oil.

* * * * *